US005300259A

United States Patent [19]

Tashiro

[11] Patent Number: 5,300,259

[45] Date of Patent: Apr. 5, 1994

[54] CARBURETOR AND FUEL FEEDING SYSTEM HAVING THE SAME

[75] Inventor: Shinichi Tashiro, 10-12, Honhaneda 1-chome, Ohta-ku, Tokyo, Japan

[73] Assignees: Shinichi Tashiro; Akira Ohshima, both of Tokyo, Japan

[21] Appl. No.: 936,407

[22] Filed: Aug. 28, 1992

[30] Foreign Application Priority Data

May 20, 1991 [JP] Japan ..... 3-115024
May 20, 1992 [JP] Japan ..... 4-151218

[51] Int. Cl.[5] ..... F02M 9/06

[52] U.S. Cl. ..... 261/44.3; 261/78.1; 261/DIG. 39; 261/DIG. 55; 251/122; 251/903; 251/333

[58] Field of Search ..... 261/44.3, DIG. 55, DIG. 39, 261/78.1; 251/122, 903, 333

[56] References Cited

U.S. PATENT DOCUMENTS

| | | | |
|---|---|---|---|
| 144,692 | 11/1873 | Murdock | 137/333 |
| 1,291,833 | 1/1919 | Godward | 261/44.5 |
| 1,734,723 | 11/1929 | Gildehaus, Jr. | 261/DIG. 55 |
| 1,968,779 | 7/1934 | Johnson | 251/122 |
| 2,649,273 | 8/1953 | Honegger | 251/333 |
| 2,659,388 | 11/1953 | Rand | 251/333 |
| 2,726,841 | 12/1955 | Crist | 251/333 |
| 2,770,443 | 11/1956 | Rand | 251/333 |
| 2,927,737 | 3/1960 | Zeuch et al. | 261/DIG. 38 |
| 3,330,543 | 7/1967 | Mennesson | 261/DIG. 38 |
| 3,635,254 | 1/1972 | Mitchell | 261/DIG. 38 |
| 3,759,499 | 9/1973 | Lang | 261/47 |
| 3,957,930 | 5/1976 | Birmingham | 261/44.3 |
| 3,995,609 | 12/1976 | Klomp | 261/DIG. 55 |
| 4,442,046 | 4/1984 | Edmonston | 261/44.3 |
| 4,926,059 | 5/1990 | Edmonston | 261/44.3 |

FOREIGN PATENT DOCUMENTS 59-90751 5/1984 Japan .

*Primary Examiner*—Tim Miles
*Attorney, Agent, or Firm*—Kanesaka & Takeuchi

[57] ABSTRACT

A carburetor and a fuel seeding system having the same including an air suction passageway through which air is fed, and a fuel feeding passageway which is disposed so as to be intersected to the air suction passageway and through which fuel is fed, the air suction passageway and the fuel feeding passageway being intercommunicated to each other. A roughened surface portion is formed on a wall surface of at least one of the air suction passageway and the fuel feeding passageway to generate turbulence in fluid flow and promote carburetion and granulation of the air-fuel mixture due to the turbulence. The tip portion of a jet needle serving as a part of the fuel feeding passageway may be provided with a substantially flat surface portion or a substantially conical surface portion having a vertical angle above 145 degrees.

15 Claims, 17 Drawing Sheets

CARBURETOR AND FUEL FEEDING SYSTEM HAVING THE SAME

BACKGROUND OF THE INVENTION

1. Field of the Invention

This invention relates to a fuel feeding system for an internal combustion engine, and particularly to a fuel feeding system having a carburetor for providing a fuel-air mixture, a fuel injection equipment, etc., and more particularly to a fuel feeding system having a carburetor for supplying fuel-air mixture (emulsion) to an engine of an automobile, a motor-bicycle, a bicycle having a motor, a pocket motorcycle, an outboard motor, a hang glider, a chain saw, a lawn mower, a road-cutter, etc., a fuel injection equipment, a fuel injection nozzle, etc.

2. Description of Related Art

A carburetor has been known as one of fuel feeding systems for mixing air and fuel in a suitable mixing ratio and then supplying air-fuel mixture to an engine of an automobile, etc. for combustion. A conventional carburetor is provided with a throttle valve disposed in an air-suction passageway so as to be movable in such a direction that air flow in the air suction passageway is suitably intercepted to form a variable venturi portion in the air-suction passageway, a fuel feeding passageway which serves to control a fuel flow (supply) amount to the venturi portion and is intercommunicated to the air suction passageway so as to be intersected to the air-suction passageway, and a tapered jet needle whose diameter is gradually reduced toward its tip portion, the rear end portion of the tapered jet needle being secured to the throttle valve while the front (tip) end portion thereof is inserted into the fuel feeding passageway. In the carburetor thus constructed, the clearance (gap) between the jet needle and the fuel feeding passageway is varied by suitably moving the throttle valve in the intersecting direction to the air suction passageway, and the fuel amount proportional to an air suction amount flowing in the venturi portion is fed to the venturi portion with controlling an air fuel ratio.

In general, the tip portion of the jet needle has a needle-shaped portion which is tapered with a constant gradient, or a conical portion which is tapered with a gradient being varied at the tip portion of the conical portion. The conical tapered jet needle generally has a vertical angle of about 60 degrees.

Further, the surfaces (walls) of the fuel feeding passageway and the jet needle along which the fuel flows are smoothly formed (smoothened) to reduce flow resistance between the fuel and the surfaces (walls). That is, each of the fuel feeding passageway and the jet needle has a smoothened or flat surface.

In this type of carburetor, when the jet needle is moved rearwardly (in such a direction that the intercommunication between the air suction passageway and the fuel feeding passageway is opened) to broaden the clearance between the jet needle and the fuel feeding passageway, the jet needle is liable to be fluctuated due to vibration of an engine, or to be downwardly pushed by air pressure in the air suction passageway, so that a fuel feeding state in the venturi portion is instabilized and thus the stability of the air fuel ratio is lost. Therefore, in the conventional carburetor having the fuel feeding system as described above, a knocking phenomenon due to reduction in combustion efficiency and a time lag to accel response (so-called discontinuous combustion) frequently occur, so that an engine efficiency is greatly reduced. The reduction of the engine efficiency causes a moderate or dull power-up of horsepower at a lower speed region (thus causes reduction in starting power), and the discontinuous combustion causes a rapid speed change (thus a violent fall of a motorbicycle, etc.).

In order to overcome the above disadvantages, the Japanese Laid-open Patent Application No. 59-90751 has proposed a fuel feeding system in which the outer diameter of a jet needle is set to be substantially equal to the inner diameter of a needle jet constituting a fuel feeding passageway to prevent the jet needle from being fluctuated over a movable region of the jet needle, and a chamfered portion is formed at the side surface of the jet needle such that clearance between the needle jet and the inner surface of the needle jet is gradually increased toward the tip portion of the jet needle.

Conventional techniques directing an improvement in performance of the above type of fuel feeding system, which representatively contains the Japanese Laid-open Patent Application No. 59-90751 as described above, have been researched and developed to mainly prevent the fluctuation of the jet needle. In addition, in these conventional techniques, the tip portion of the jet needle has been commonly formed in a conical shape having an acute vertical angle in consideration of the basic concept of hydrodynamics that smooth flow of fuel can be obtained by reducing flow resistance of the fuel.

However, according to the consideration of the inventor of this application, the low combustion efficiency of the conventional fuel feeding system can be estimated not to be caused by the instability of the air fuel ratio due to the fluctuation of the jet needle, but to be caused by the following two points.

Firstly, the low combustion efficiency would be caused by the smoothened (flat) wall surface of a fluid passageway such as a fuel feeding passageway, an air suction passageway, etc., along which fuel, air or air-fuel mixture flows in contact with the wall surface thereof although the smoothened surface itself is considered as a most preferable surface on the basis of the hydrodynamics. That is, since the wall surface of the fuel feeding passage or the surface of the jet needle (hereinafter referred to as "wall surface") is smoothly (flatly) formed in a conventional fuel feeding system, a boundary layer is formed between the surface wall of each of the fuel feeding passageway and the jet needle and the fuel due to friction therebetween. The flow of the fluid such as fuel, air or air-fuel mixture is decelerated by the boundary layer, so that the fuel feeding is restricted or disturbed. This restriction or disturbance of the fluid flow by the boundary layer mainly causes the instability of the air fuel ratio. Therefore, the conventional fuel feeding system can not provide an ideal air combustion ratio. In addition, difficulty in increase of air suction amount for power-up would be also caused by the smoothly-formed (smoothened) surface wall of the air suction passageway. When the clearance between the jet needle and the fuel feeding passageway is small, the clearance would be mostly occupied by the boundary layer, and thus the flow resistance of the fuel would be remarkably great.

Therefore, if the area of the boundary layer is reduced in the fluid passageway, the flow condition of fuel, etc. could be approached to an ideal condition in which no friction occurs between the fluid (fuel, air, air-fuel mixture) and the wall surface of the fluid passageway, and thus the flow resistance could be reduced to increase the fuel feeding amount, so that an ideal (optimum) air fuel ration can be obtained to improve the combustion efficiency.

Further, conventionally, only the clearance between the jet needle and the fuel feeding passageway has been considered, but no consideration or attention has been paid to the flow resistance caused by the boundary layer, and thus it has been conventionally difficult to control the fuel flow amount in proportion to the clearance. Therefore, the design and setting of peripheral equipments of the jet needle have not been simply performed, and skilled sense and experience have been required for the design and the setting.

Secondly, the low combustion efficiency would be caused by stable fluidity of fuel which is controlled by the shape of the tip portion of the jet needle. That is, the fuel is allowed to smoothly flow through the clearance between the jet needle and the needle jet by an acute shape of the tip portion of the jet needle and thus the fluidity of the fuel itself is stabilized irrespective of the instability of the fuel feeding to the venturi portion. This stability of the fluidity of the fuel causes insufficient fine-granulation of the fuel in the venturi portion where the air-fuel mixture is generated and/or insufficient turbulence of the air-fuel mixture, so that a flaming speed in a combustion chamber can not be improved. Accordingly, if the stable fluidity of the fuel in the clearance between the jet needle and the needle jet is intentionally disturbed to form turbulent flow of the fuel in the clearance, the turbulent flow of the fuel would cause the turbulence of the air-fuel mixture and thus improve the combustion efficiency.

SUMMARY OF THE INVENTION

An object of this invention is to provide a carburetor and a fuel feeding system having the carburetor in which the area of a boundary layer in a fluid passageway for fuel, air and air-fuel mixture can be reduced to obtain a optimum air fuel ratio and thus improve a combustion efficiency, so that knocking and discontinuous combustion phenomena can be prevented.

Another object of this invention is to provide a carburetor and a fuel feeding system having the carburetor whose constituting elements can be easily designed and set up to improve its availability.

Another object of this invention is to provide carburetor and a fuel feeding system having the carburetor in which fine-granulation of fuel and turbulence of air-fuel mixture can be performed to improve the combustion efficiency, and the knocking and discontinuous combustion can also be prevented.

In order to achieve the above objects, according to one aspect of this invention, a carburetor for generating air-fuel mixture in a suitable air-fuel ratio and feeding the mixture to an engine for combustion comprises an air suction passageway through which air is fed, and a fuel feeding passageway which is disposed so as to be intersected to the air suction passageway and through which fuel is fed, the air suction passageway and the fuel feeding passageway being intercommunicated to each other, wherein a roughened surface portion is formed partly or wholly on a wall surface of at least one of the air suction passageway and the fuel feeding passageway to generate turbulence in fluid flow and promote carburetion and granulation of the air-fuel mixture due to the turbulence.

The fuel feeding passageway comprises a needle jet intercommunicated to the air suction passageway for guiding the fuel flow into the air suction passageway, and a jet needle which has a tapered portion and is movably inserted into the needle jet, clearance between the jet needle and the needle jet being adjustable by moving the jet needle in the axial direction thereof to control an amount of fuel to be fed into the air suction passageway in accordance with an opening degree of the clearance.

The tip portion of the jet needle may be provided with a substantially flat surface or a substantially conical surface having a vertical angle above 145 degrees.

According to another aspect of this invention, a fuel feeding system for feeding air-fuel mixture to an engine in a suitable air-fuel ratio for combustion in the engine comprises an air suction passageway through which air is fed, and a fuel feeding passageway along which fuel is fed, the air suction passageway and the fuel feeding passageway being intercommunicated to an engine to feed air-fuel mixture to the engine for combustion, wherein a roughened surface portion is formed partly or wholly on a wall surface of at least one of the air suction passageway and the fuel feeding passageway to generate turbulence in fluid flow and promote carburetion and granulation of the air-fuel mixture due to the turbulence.

According to the carburetor and the fuel feeding system having the same of this invention, the area of a boundary layer occurring between the wall surface of the fuel feeding passageway and the fuel is reduced by the formation of the roughened surface portion. That is, the fuel is stored into the recesses of the roughened surface portion, and the flow resistance is mostly caused by the same fluid (fuel), so that the deceleration of fluid flow due to the flow resistance between the wall surface of the fuel feeding passageway and the fuel can be mostly prevented. Therefore, the fluid flow is approached to an ideal fluid flow, and thus the fuel feeding for air-fuel mixture can be smoothly carried out and an optimum air-fuel ratio can be obtained.

Further, according to this invention, the thickness and area of a boundary layer occurring between the air suction passageway and air is reduced by formation of the roughened surface portion. Therefore, the air flow is approached to an ideal air flow, and the air suction amount is increased, so that the fuel flow is changed from a laminar flow to a turbulent flow at the roughened surface portion. This turbulent flow causes the fuel flow to be slightly vibrated, and the atomization and carburetion of the fuel is promoted.

Still further, according to this invention, since the tip portion of the jet needle is shaped in a flat form or in a substantially flat surface form, the fuel which is sucked into the air suction passageway due to the negative pressure of the air flow in the air suction passageway collides against the tip portion of the jet needle, and the smoothly propagating flow is prevented by the substantially flat tip surface of the jet needle. Through the collision between the fuel flow and the flat tip portion of the jet needle, eddy occurs at the rear side of the flat tip portion (downstream of the fuel flow), and the turbulence flow occurs in clearance between the jet needle and the needle jet, whereby the granulation of the fuel and the turbulence of the air-fuel mixture are performed when the air-fuel mixture is formed in the air suction passageway.

DETAILED DESCRIPTION OF THE PREFERRED EMBODIMENTS

A first embodiment of this invention will be described hereunder with reference to FIGS. 1 to 4.

Figure 1:
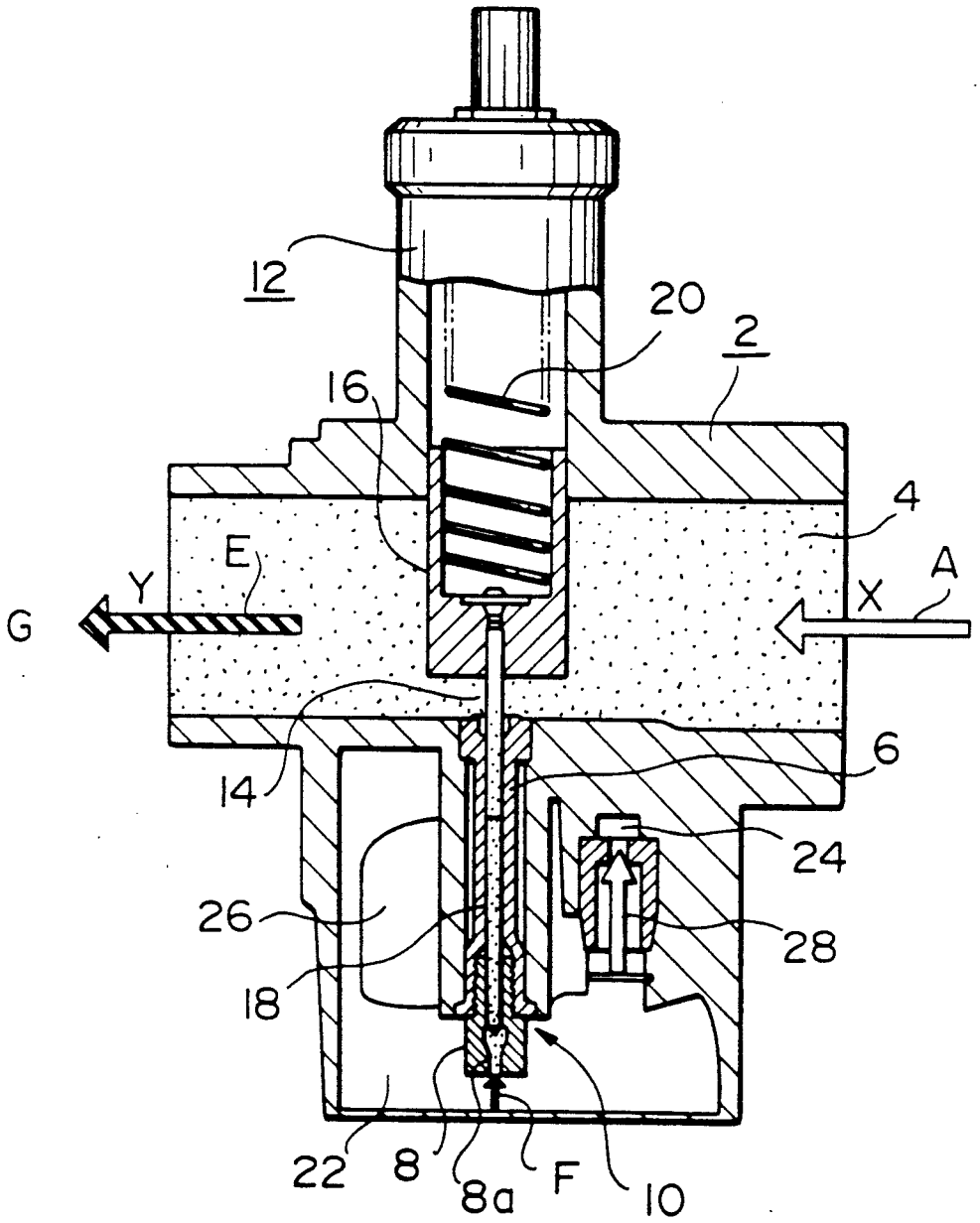
FIG. 1 shows the schematic construction of an embodiment of a carburetor according to this invention.

FIG. 1 shows the schematic construction of an embodiment of a carburetor according to this invention.

As shown in FIG. 1, the carburetor 2 includes an air suction passageway 4 intercommunicated to an engine side G, a fuel feeding passageway 10 which mainly comprises a needle jet 6 and a main jet 8 and is intercommunicated to the air suction passageway 4 at the lower side of the air suction passageway 4 so as to be intersected perpendicular as shown in FIG. 1 to the air suction passageway 4, and a throttle mechanism 12 disposed at the upper side of the air suction passageway 4. The throttle mechanism 12 is provided with a throttle valve 16 which is movable in such a direction that it suitably intercepts the air flow in the air suction passageway 4 to form a venturi portion in the air suction passageway 4.

Further, a jet needle 18 serving as a part of the fuel feeding passageway 10 is secured to the lower side of the throttle valve 16, and the free end (tip) portion of the jet needle 18 is movably inserted into the needle jet 6. The throttle valve 16 is downwardly urged by a spring member 20, and its vertical movement (ascending and descending operation or amount) is adjustable by a throttle lever (not shown).

The carburetor 2 is further provided with a fuel tank 22 at the lower side of the air suction passageway. The fuel tank 22 is provided with a fuel feeding inlet 24 through which fuel is supplied to the fuel tank 22, and a float 26 which is connected to a control valve 28. The fuel feeding (supply) into the fuel tank 22 is controlled by the control valve 28. Arrows A, E and F as shown in FIG. 1 indicate fluid flow directions of sucked air, air-fuel mixture and fuel, respectively.

The main jet 8 disposed at the lower side of the needle jet 6 has a throttling portion 8*a*, and the amount of fuel which is sucked into the venturi portion by a negative-pressure action of the sucked air A flowing from the upstream side X to the downstream side in the air suction passageway 4 is first roughly adjusted through the throttling portion 8*a*.

Figure 2:
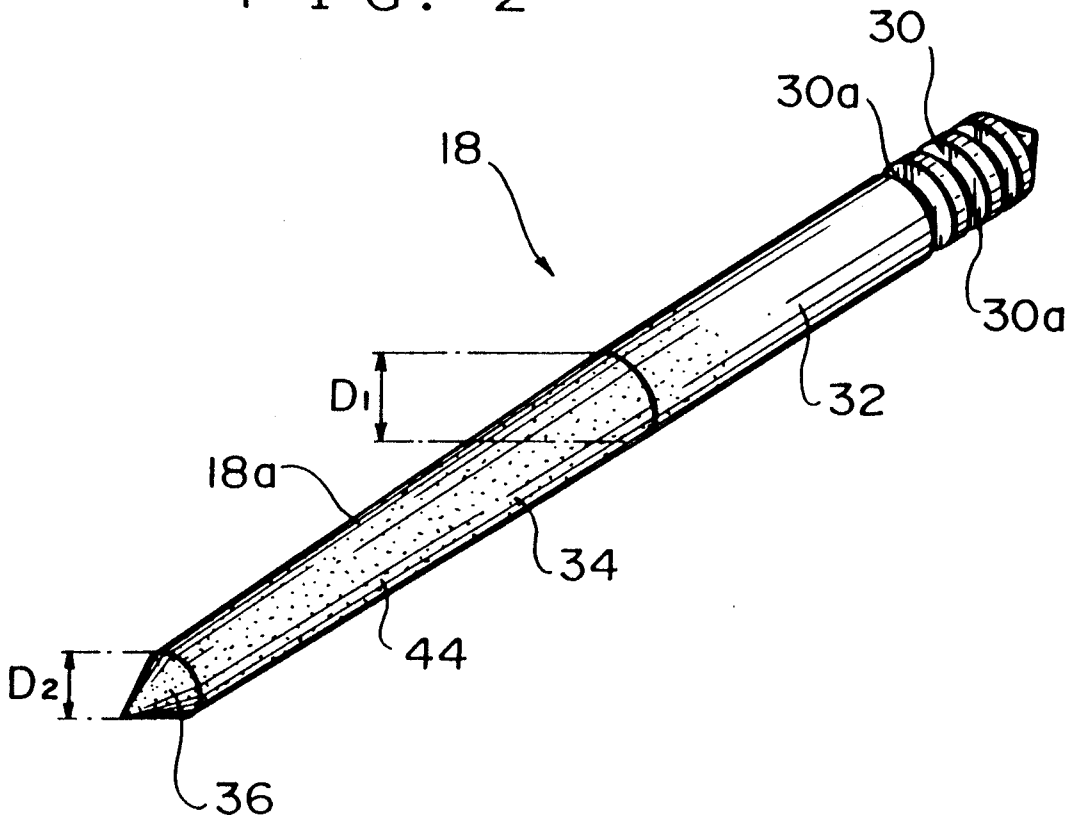
FIG. 2 is a perspective view of an embodiment of a jet needle used in the carburetor as shown in FIG. 1.

FIG. 2 shows the schematic construction of the jet needle 18 of this embodiment. As shown in FIG. 2, the jet needle 18 is formed of four bodies which are integrally linked in series into one body. A first body comprises a securing portion 30 which is secured to the lower portion of the throttle valve 16 through an engaging ring or the like. The securing portion 30 is provided with plural recess portions 30*a* at the peripheral surface thereof, and the securing position of the securing portion 30 to the throttle valve 16 is freely adjustable by engaging a desired one of the recess portions 30*a* with the throttle valve 16. A second body comprises a cylindrical body 32 having a constant diameter D1 which is continuously (integrally) linked to the securing portion 30. A third body comprises a tapered body 34 whose diameter is gradually decreased toward the tip portion thereof and has a final diameter D2 at the tip thereof. The tapered body 34 is continuously (integrally) linked to the cylindrical body 32. A fourth body comprises a conical body 36 having a vertical angle of 120 degrees which is continuously (integrally) linked to the tapered body 34.

Figure 4:
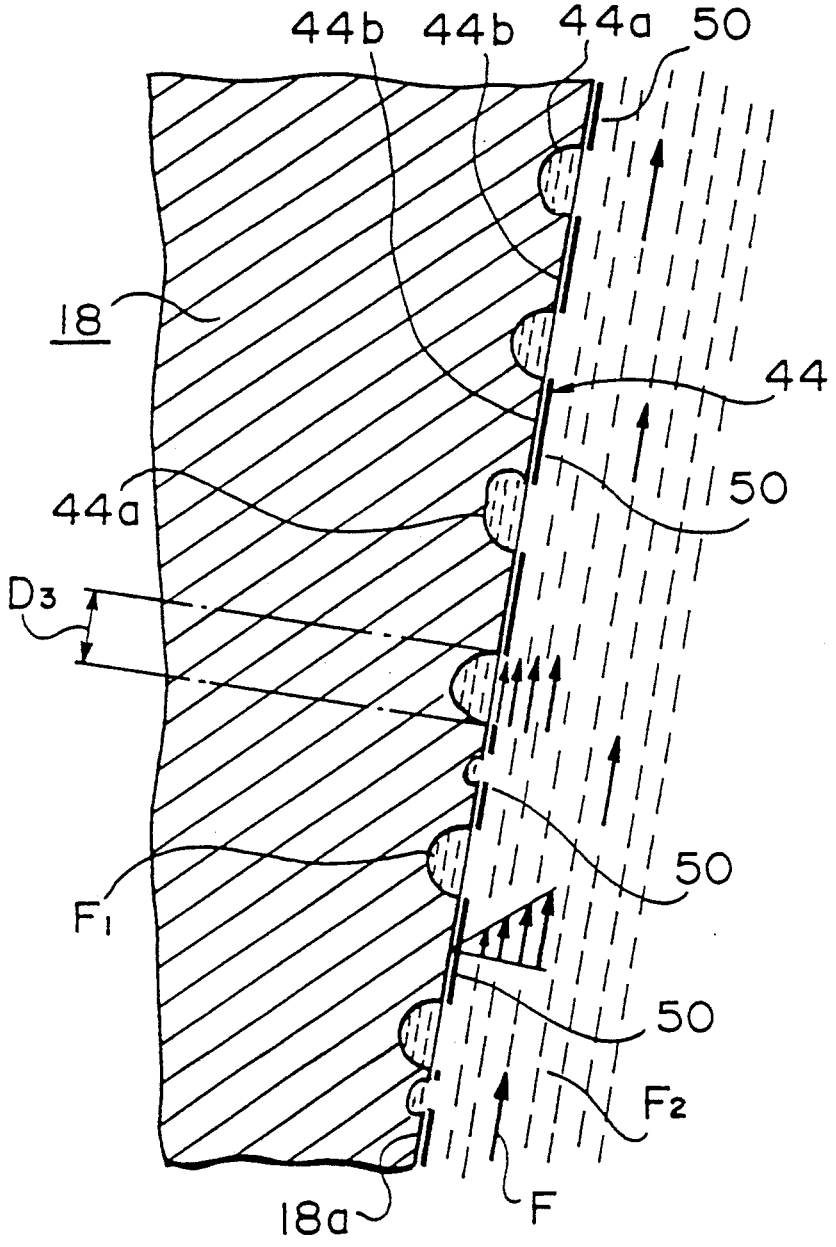
FIG. 4 is an enlarged sectional view of the jet needle for showing reduction of flow resistance by a roughened surface portion.

The wall surface 4*a* of the air suction passageway 4, the wall surface 8*a* of the main jet 8 and the wall surface 18*a* of the jet needle 18 are partly or wholly formed with roughened surface portions 40, 42 and 44 respectively by a shot peening treatment as shown in FIG. 4. In this embodiment, the shot peening treatment is suitable carried out such that the roughness of each of the roughened surface portions 40, 42 and 44, that is, the diameter D3 of each recess 44*a* as shown in FIG. 4 is approximately equal to 1/100 mm, for example.

The operation of the carburetor 2 and the effect of increasing the fuel feeding amount and the air suction amount by the roughened portions 40, 42 and 44 will be next described.

Figure 3:
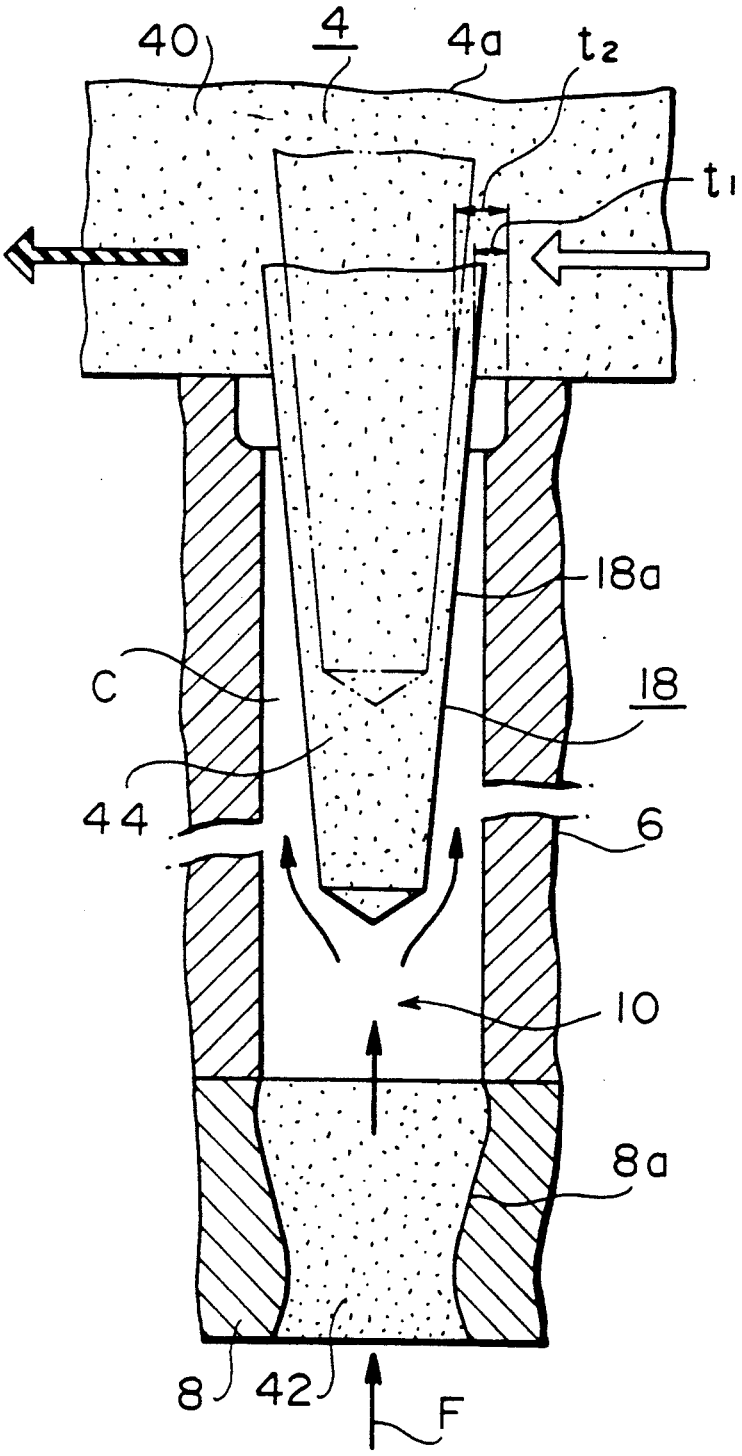
FIG. 3 is a side view of the carburetor of FIG. 1 for showing air-fuel mixture formation.

Upon manipulation of the throttle lever in an opening direction, the jet needle 18 is upwardly moved as shown in FIG. 3. Through this operation, the clearance C between the jet needle 18 and the needle jet 6 is broadened (an opening degree of the throttle valve 16 is increased) so that the sectional area of the clearance is increased from t1 to t2, and fuel F is supplied to the venturi portion 14 in correspondence with the air suction amount which corresponds to the opening degree of the throttle valve 16 to thereby adjust the air-fuel ratio.

The effect of the roughened portions of the 40, 42 and 44 will be described, representatively using the jet needle 18.

As shown in FIG. 4, the roughened portion 44 formed on the wall surface 18*a* of the jet needle 18 comprises recesses 44*a* which are formed by the shot peening treatment and projections 44*b* which are apparently formed relatively to the recesses 44*a*. When the fuel F flows through the clearance in contact with the wall surface 18*a* of the jet needle 18, the flow deceleration of the fuel F occurs between the projections 44*b* and the fuel F due to flow resistance therebetween, and thus a boundary layer 50 is formed between each of the projections 44*b* and the fuel F. On the other hand, the fuel flow is not decelerated between each of the recesses 44*a* and the fuel F because the fuel F1 is stored in the recesses 44*a* and thus sliding contact (no friction) occurs between the fuel F1 and the outer fuel F2 (between the same fuels). Therefore, an ideal fluid flow is approximately formed between each of the recess portions 44*a* and the fuel F.

In comparison with the conventional carburetor which has a smoothened surface portion (no roughened portion), an occupy ratio of the boundary layer 50 over the wall surface 18*a* is more decreased in the carburetor of this embodiment, so that the fuel flow suffers only a slight amount of flow decelerating action of the boundary layer 50 even when the clearance C is small. Therefore, the fuel feeding is promoted and an optimum air-fuel ratio providing high power output is realized. The above effect can be obtained for the main jet 8 in the same manner, and also the air suction amount in the air suction passageway 4 can be increased in the same manner as described above.

Figure 5:
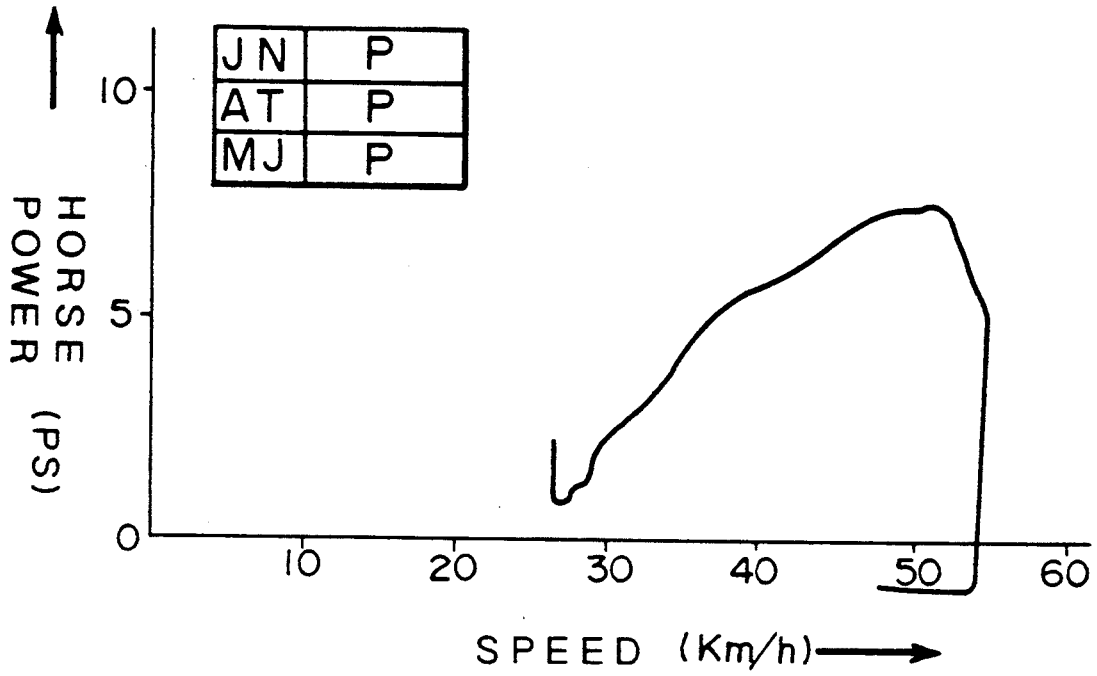
FIG. 5 is a graph showing an experiment result of a power test for the embodiment.
Figure 14:
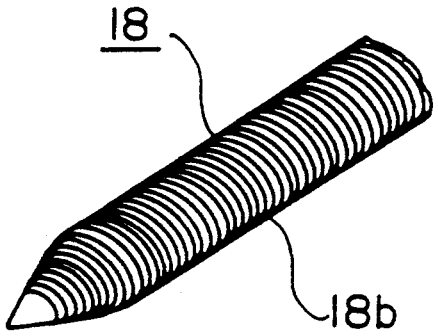
FIG. 14 is a perspective view of another embodiment of the jet needle.

FIG. 5 is a graph showing an experimental result of a power test of the carburetor as described above. A carburetor of Keihin PF70 which has a venturi diameter of 18 mm and is produced by Keihin Seiki Company was used as a carburetor for test, and a car of Honda NSR50 (produced by Honda company) was used as a test car. In FIG. 5, the ordinate and abscissa of the graph represent horsepower and speed per hour, respectively. FIGS. 6 to 12 are graphs showing experimental results obtained when a roughened surface forming condition is varied. A table at the upper and right side of each graph represents the roughened surface forming condition for the graph. In the table, reference characters JN, AT and MJ represent the jet needle 18, the air suction passageway 4 and the main jet respectively, and reference characters P, W and S represent roughened surface formation by shot peening treatment, roughened surface formation by a corrugating treatment and no roughened surface formation (standard mode), respectively. The wave formation was carried out by a threading treatment in a cutting method to form a spiral groove 18*a* in 1/100 mm depth on the wall surface of the jet needle as shown in FIG. 14.

Figure 13:
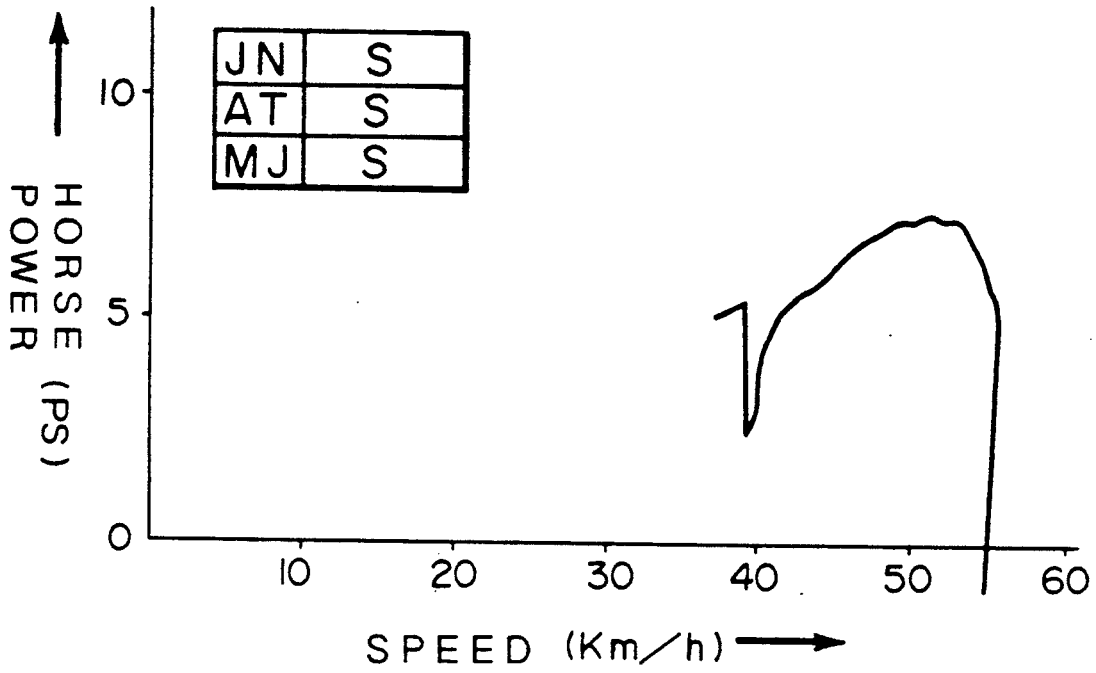
FIG. 13 is a graph showing an experimental result of a power test for another example.

FIG. 13 is a graph showing an experimental result of a conventional carburetor whose elements were formed in the standard mode (that is, no roughened surface formation). In this case, torque in a low-speed region was very low, and thus it was impossible to make a measurement at a third gear speed which was commonly made for the other cases. Therefore, in the measurement for the experiment of FIG. 13, a test car was first accelerated at a second gear speed, and then changed to the third gear speed, so that no experimental result below 40 Km/h was obtained in the graph of FIG. 13. As is apparent from comparison between the experimental graphs, this fact means that increase of torque in an ordinary rotating region (low and intermediate speed rotating regions) can be achieved even when the roughened surface formation is made to at least one of the air suction passageway 4, the main jet 8 and the jet needle 18.

Figure 6:
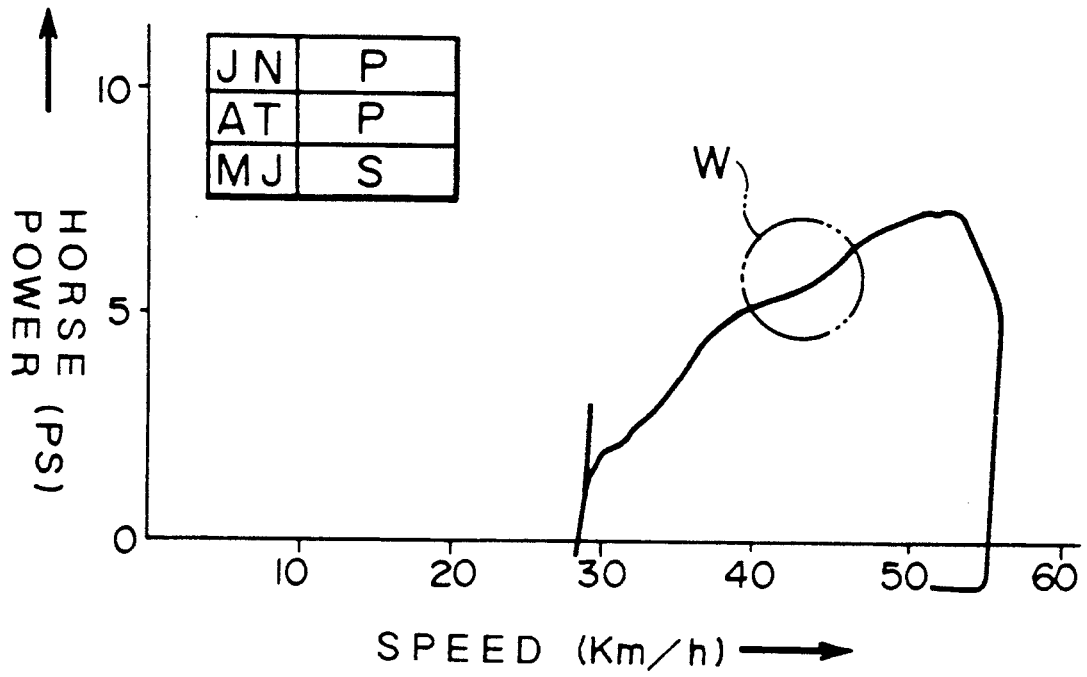
FIG. 6 is a graph showing an experimental result of a power test for another example.

In FIG. 6 (where the main jet 8 had no roughened surface portion), the air suction amount into the air suction passageway 4 was increased due to the roughened surface formation on the air suction passageway 4, and so-called torque valley in which the acceleration is moderated due to unbalance of the air-fuel ratio was observed. The increase of the air suction amount due to the roughened surface portion is also proved by the fact that the torque valley was extinguished in the graph of FIG. 5 where the roughened surface formation was also made to the main jet 8.

Figure 7:
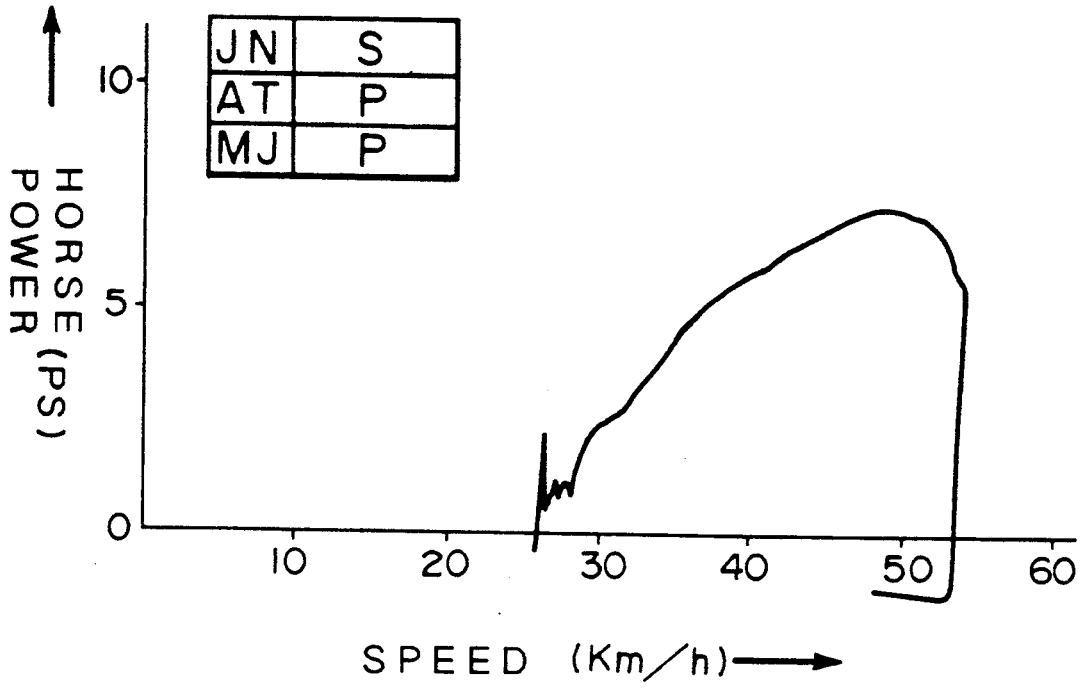
FIG. 7 is a graph showing an experimental result of a power test for another example.
Figure 8:
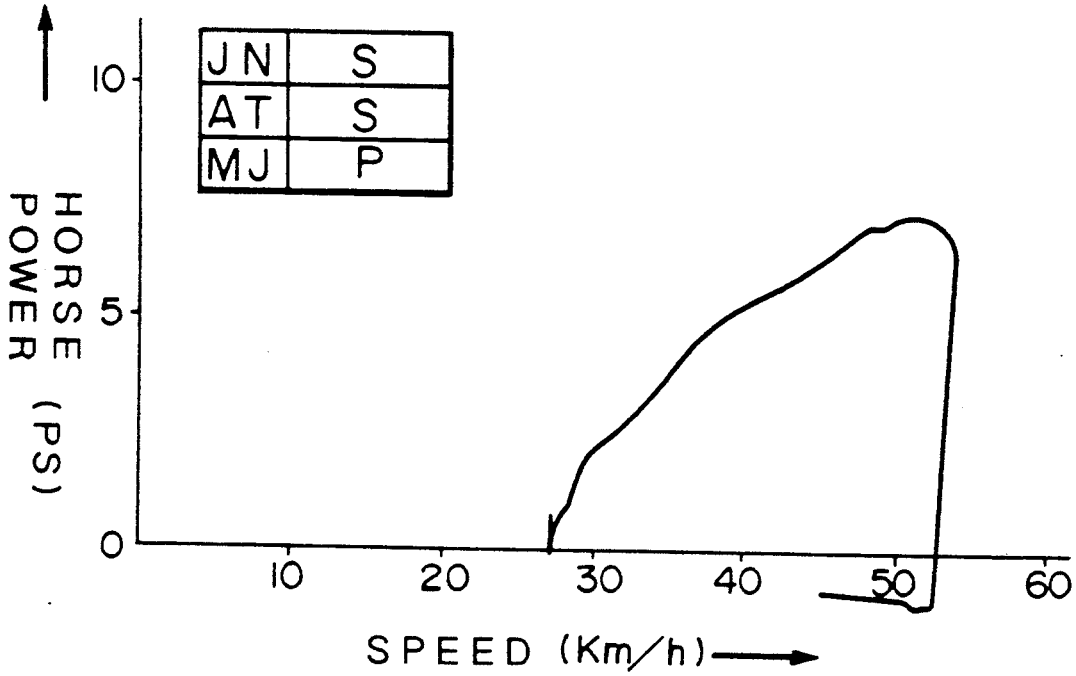
FIG. 8 is a graph showing an experimental result of a power test for another example.

In comparison with the graphs of FIGS. 7 and 8, it is apparent that the decrease of torque after passing over the peak (maximum) power is more moderate in the example of FIG. 7 where the roughened surface formation was made to both of the main jet 8 and the air suction passageway 4 than in the example of FIG. 8 where the roughened surface formation was made to only the main jet 8. Therefore, the torque-up could be performed if the roughened surface formation is made with keeping the balance of the air-fuel ratio.

Figure 9:
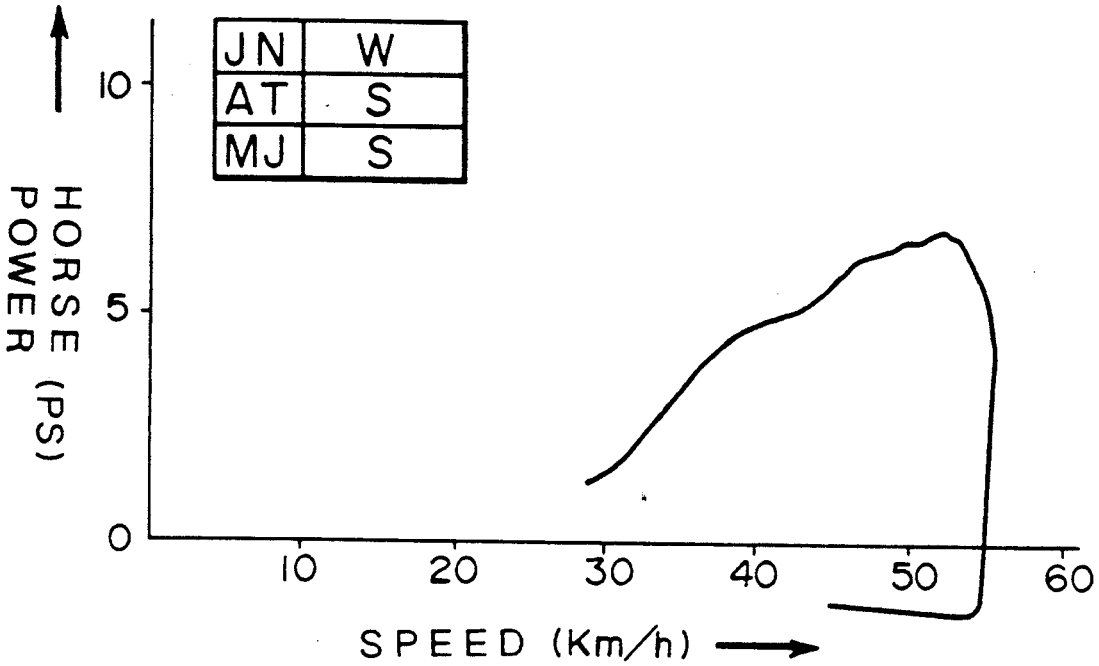
FIG. 9 is a graph showing an experimental result of a power test for another example.
Figure 10:
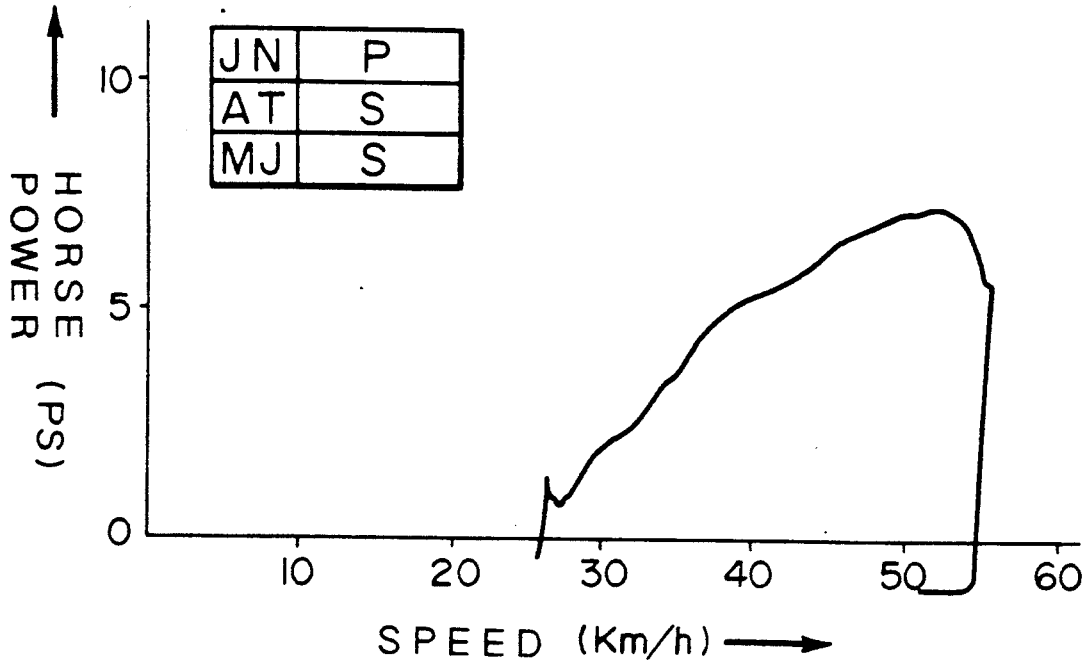
FIG. 10 is a graph showing an experimental result of a power test for another example.

A different point between the examples of FIGS. 9 and 10 is difference in roughened surface forming manner (that is, corrugating treatment and shot peening treatment). As is apparent from the graphs, the example using the shot peening treatment as shown in FIG. 10 has a slightly more power-up than the example using the corrugating treatment as shown in FIG. 9.

Figure 11:
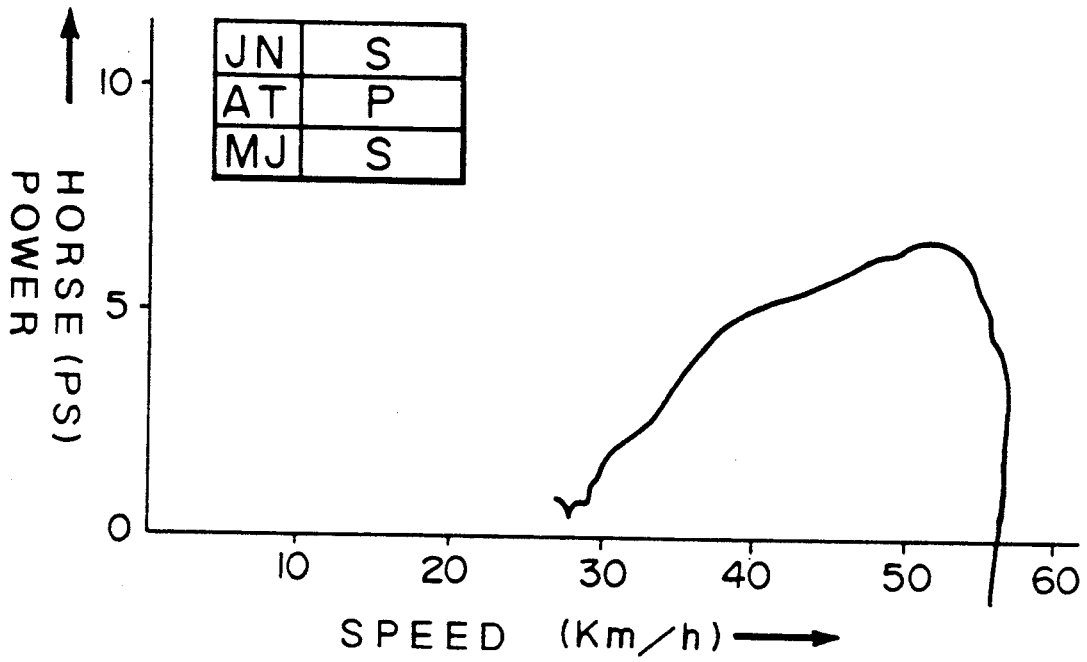
FIG. 11 is a graph showing an experimental result of a power test for another example.
Figure 12:
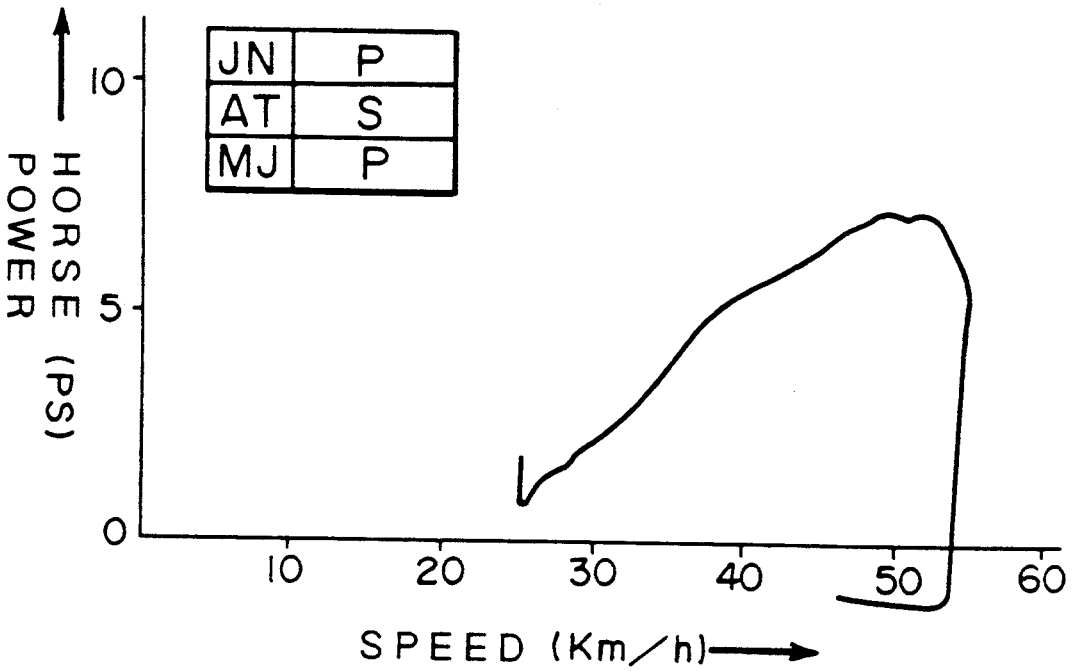
FIG. 12 is a graph showing an experimental result of a power test for another example.

The example of FIG. 11 where the roughened surface formation was made to only the air suction passageway 4 provides increase of the air suction amount. In this example, the increase of the torque at the high-speed rotating region is sharper and the decrease of the torque is more moderate than the other cases (so-called top-out does not occur). The total increase of the horsepower can be easily performed in accordance with the increase of the air suction amount by changing the size of the main jet 8.

As described above, the increase of the horsepower and prevention of the discontinuous combustion can be easily performed by forming the roughened surface portion on the passageway for fluid such as fuel F, air and so on. In addition, since the control of flow amount in proportion to the clearance can be performed, the peripheral elements of the jet needle 18 can be easily set up and designed, and the availability of the carburetor can be improved. Further, the increase of the air suction amount and the fuel feeding amount enables miniaturization, light weight and low manufacturing cost of the carburetor.

In the above examples, the roughened surface portions 40, 42 and 44 are formed substantially wholly over the air suction passageway 4 and the fuel feeding passageway comprising the main jet 8 and the jet needle 18, however, may be formed partly insofar as the effect as described above is obtained.

As is apparent from each graph, the roughened surface formation may be made to any one of the air suction passageway 4 and the fuel feeding passageway 10.

In the above examples, the shot peening method and the cutting method are adopted as the roughened surface forming means, however, this invention is not limited to these methods. Various methods such as etching, sand blast, coating, dimple processing, knurling processing, etc., may be used.

Figure 15:
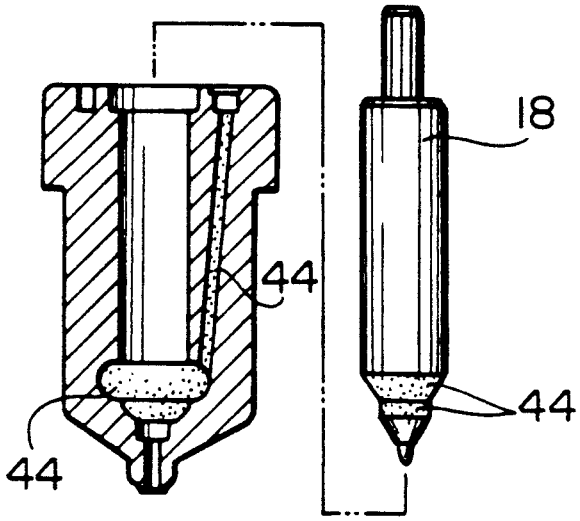
FIG. 15 is a cross-sectional view of a fuel injection nozzle to which the first embodiment is applied.
Figure 16:
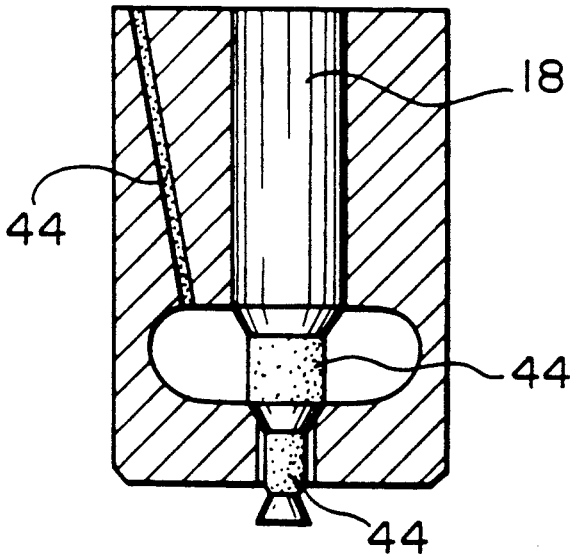
FIG. 16 is a cross-sectional view of a throttle type nozzle to which the first embodiment is supplied.

The embodiment as described above is applied to a variable venturi type of carburetor, however, this invention is not limited to this type. For example, this invention is applicable to a fixed venturi type of carburetor, and as shown FIGS. 15 and 16, a roughened surface portion 44 may be formed on a sheet surface and a portion which is not contacted with the sheet surface. A main jet, a needle, a main nozzle or a throw jet may be used as a member to be formed with the roughened surface portion 44.

As described above, according to the above embodiment, the flow resistance of fuel or air can be reduced by providing the roughened surface portion to the fluid passageway for fuel or air, and atomization and carburetion of the fuel can be promoted, so that the optimum air-fuel ratio can be obtained to improve the horsepower and prevent the discontinuous combustion. In addition, the flow amount of the fuel can be proportionally adjustable, so that the design and set-up of the peripheral elements of the jet needle can be easily performed and the availability can be improved.

Further, the increase of the fuel feeding amount or the air suction amount enables the miniaturization of the carburetor, so that the weight of the carburetor can be lightened and the manufacturing cost thereof can be reduced.

A second embodiment of this invention will be next described. The basic construction of the fuel feeding system and the fuel feeding operation to the engine in the second embodiment are substantially identical to those of the first embodiment as shown in FIG. 1, except for the construction of the jet needle. Therefore, the detailed description of the same elements and construction as those of the first embodiment is eliminated hereunder, and only the different elements and construction will be described in detail. In the following description, the same elements as those of the first embodiment are represented by the same reference numerals.

Figure 17:
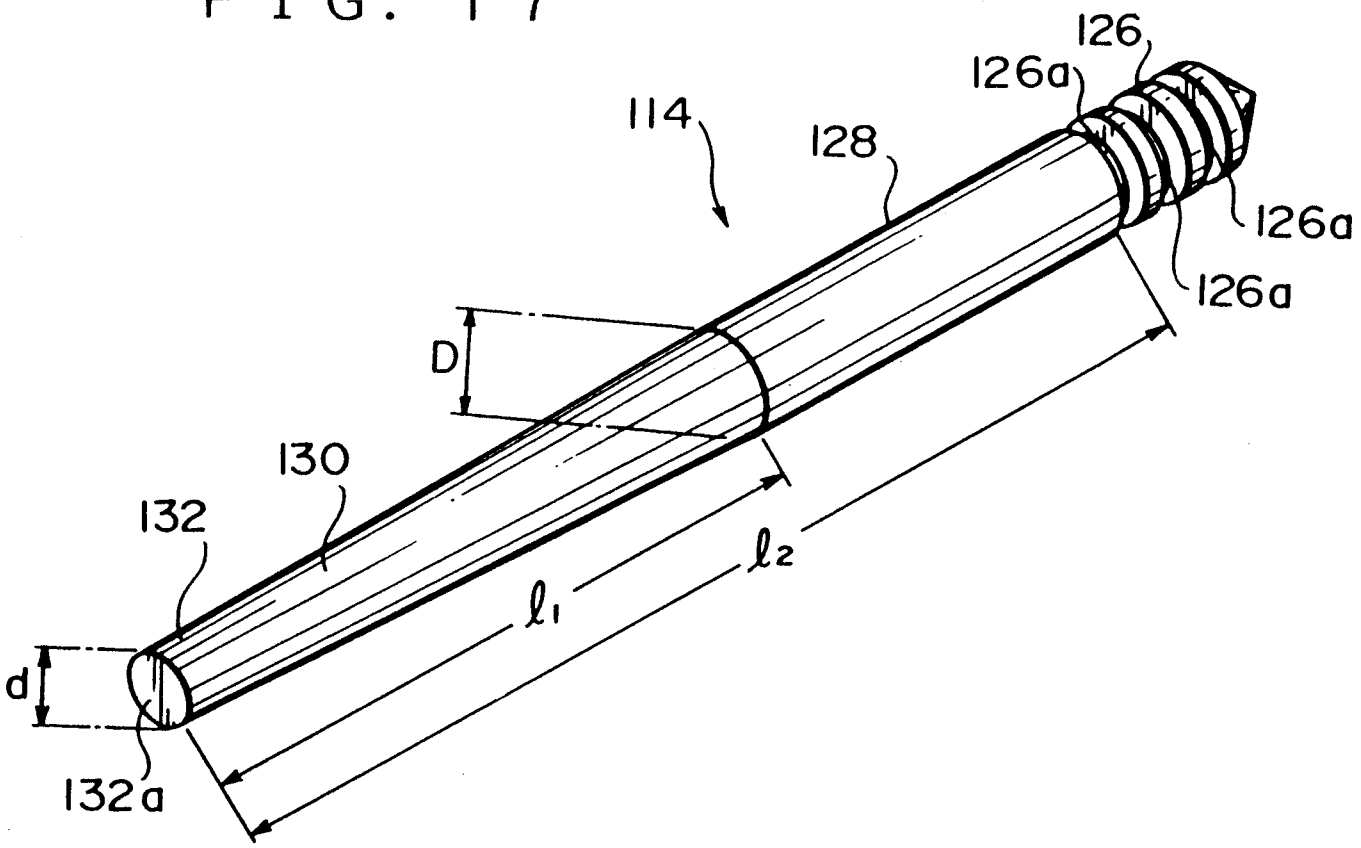
FIG. 17 is a perspective view of another embodiment of the jet needle according to this invention.

FIG. 17 shows the schematic construction of a jet needle 114 which is used in the second embodiment. Like the first embodiment, the jet needle 114 of the second embodiment includes a first body comprising a securing portion 126 having plural recesses 126*a*, a second body comprising a cylindrical body 128 having a constant diameter of D, and a third body comprising a tapered body 130 having a minimum diameter of d at the tip portion thereof. However, unlike the first embodiment, the jet needle of this embodiment has no fourth body (i.e., a conical body), and the end surface of the tapered body 130 has a substantially flat surface portion 132*a* which is substantially vertical to the axis thereof, that is, the tapered body 130 is designed in a substantially conical form with its apex being cut or in a substantially cylindrical form. In FIG. 17, l1 and l2 represent the length of the tapered body 130 and the total length of the tapered body 130 and the cylindrical body 128, respectively.

A stirring action of fuel F by the jet needle 114 having the flat surface at the 132*a* at the tip thereof will be next described with reference to FIG. 18.

Figure 18:
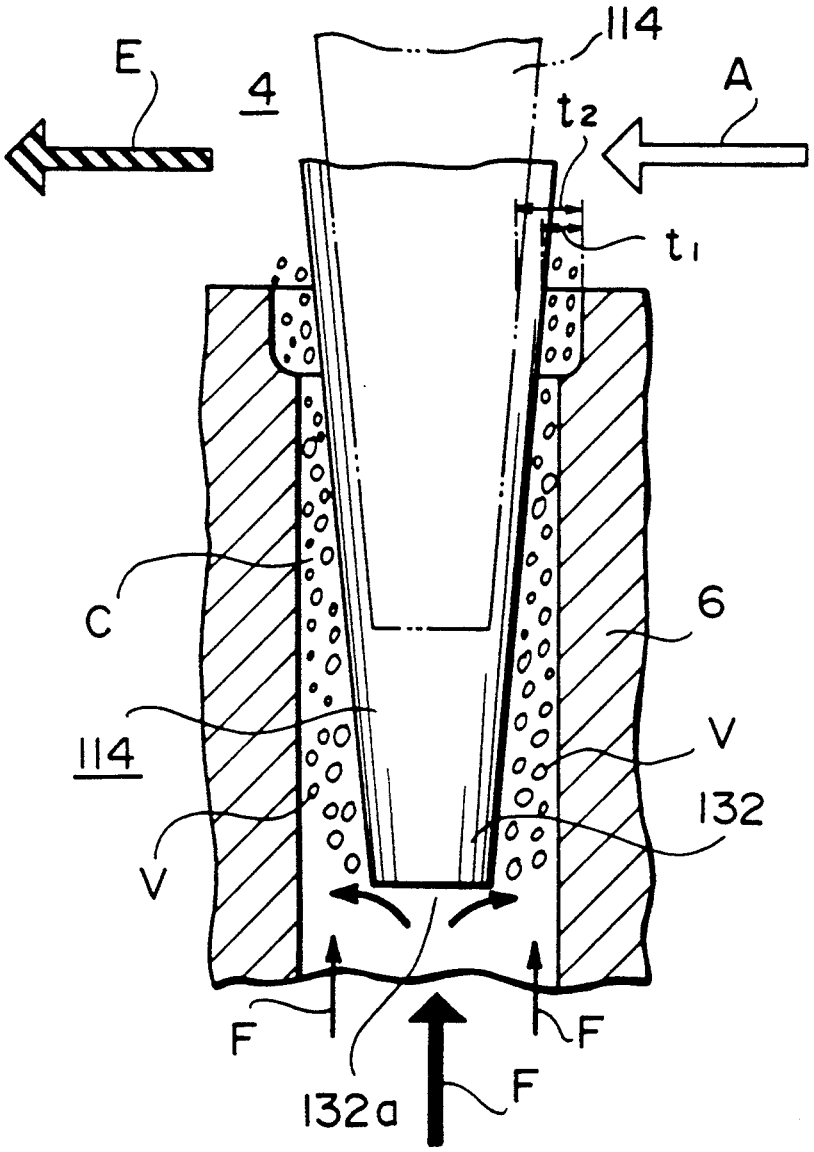
FIG. 18 is a cross-sectional view of the carburetor having the jet needle of FIG. 17 for showing turbulence of fuel flow.

Upon manipulation of the throttle lever in an opening direction, the jet needle 114 is upwardly moved as shown in FIG. 18. Through this operation, the clearance C between the jet needle 114 and the needle jet 6 is increased so that the sectional area of the clearance C is increased from t1 to t2, and fuel F is supplied to the venturi portion in correspondence with the air suction amount which corresponds to an opening degree of the throttle valve 16 to adjust the air-fuel ratio. The fuel F which upwardly flows through the main jet 8 is inhibited from propagating straightly by the flat surface portion 132*a*, and its propagating or flowing direction is forcedly and rapidly altered, so that the flow of the fuel F is disturbed or turbulent. Therefore, eddy occurs at the rear side of the flat surface portion 132*a* in the clearance C between the jet needle 114 and the needle jet 6, and the fuel flow in the clearance is greatly stirred. Through the eddy occurrence as described above, the fine granulation of the fuel F and the turbulence of air-fuel mixture E can be performed when fuel and air are mixed with each other.

Figure 19:
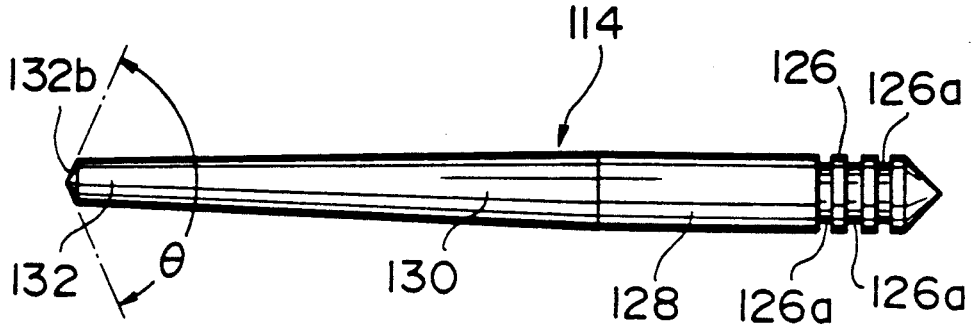
FIG. 19 shows a modification of the jet needle as shown in FIG. 17.

The tip portion of the jet needle 114 is not necessarily required to be shaped in a flat form, various modifications may be made to the shape of the tip portion of the jet needle 114. For example, as shown in FIG. 19, the tip portion may be designed in a substantially conical form (132*b*) having a vertical angle $\theta$ above 145 degrees which is approximate to a flat surface.

Figure 20:
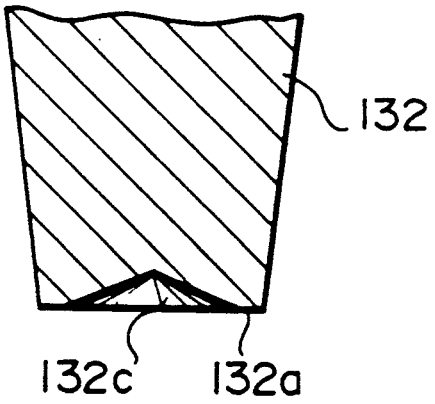
FIG. 20 shows another modification of the jet needle as shown in FIG. 17.
Figure 21:
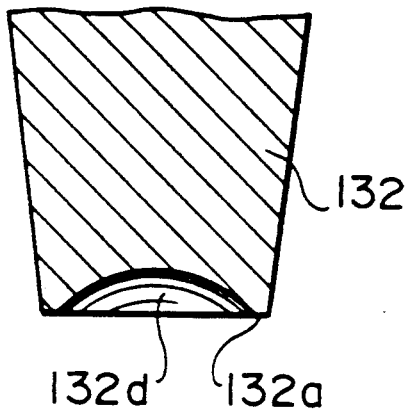
FIG. 21 shows another modification of the jet needle is shown in FIG. 17.
Figure 22:
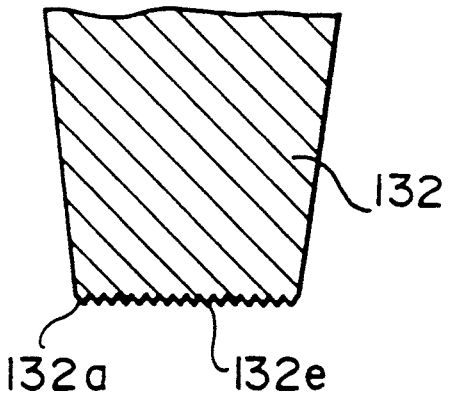
FIG. 22 shows another modification of the jet needle as shown in FIG. 17.
Figure 23:
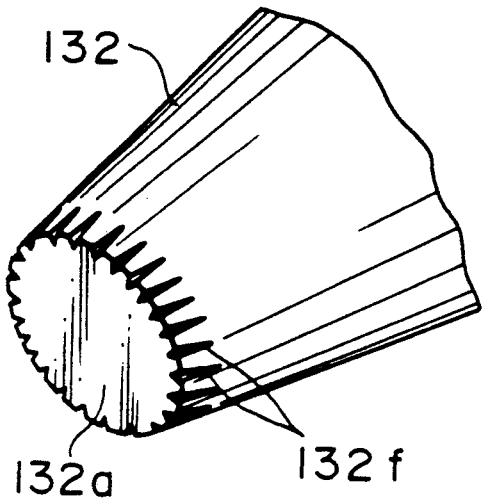
FIG. 23 shows another modification of the jet needle as shown in FIG. 17.
Figure 24:
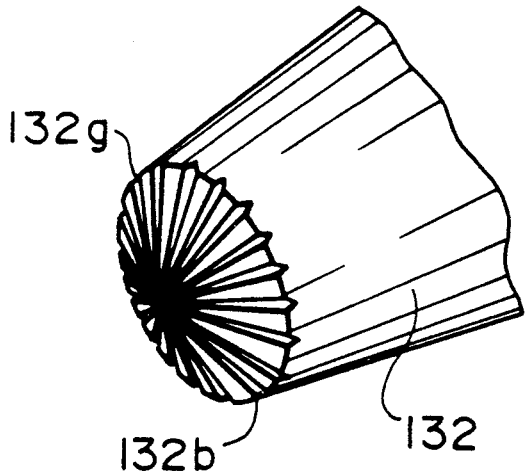
FIG. 24 shows another modification of the jet needle as shown in FIG. 17.

As a modification, a conical recess portion 132*c* as shown in FIG. 20 or a semi-spherical recess portion 132*d* as shown in FIG. 21 may be formed in the flat surface portion 132*a*. As another modification, an uneven portion 132*e* as shown in FIG. 22 may be formed on the flat surface portion 132*a* by a punch or the like. As another modification, notches 132*f* as shown in FIG. 23 may be formed on the periphery of the flat surface portion 132*a*. Further, as another modification, the substantially conical tip surface portion 132*b* having the vertical angle above 145 degrees as shown in FIG. 19 may be formed with notches 132*g* thereon as shown in FIG. 24.

Figure 25:
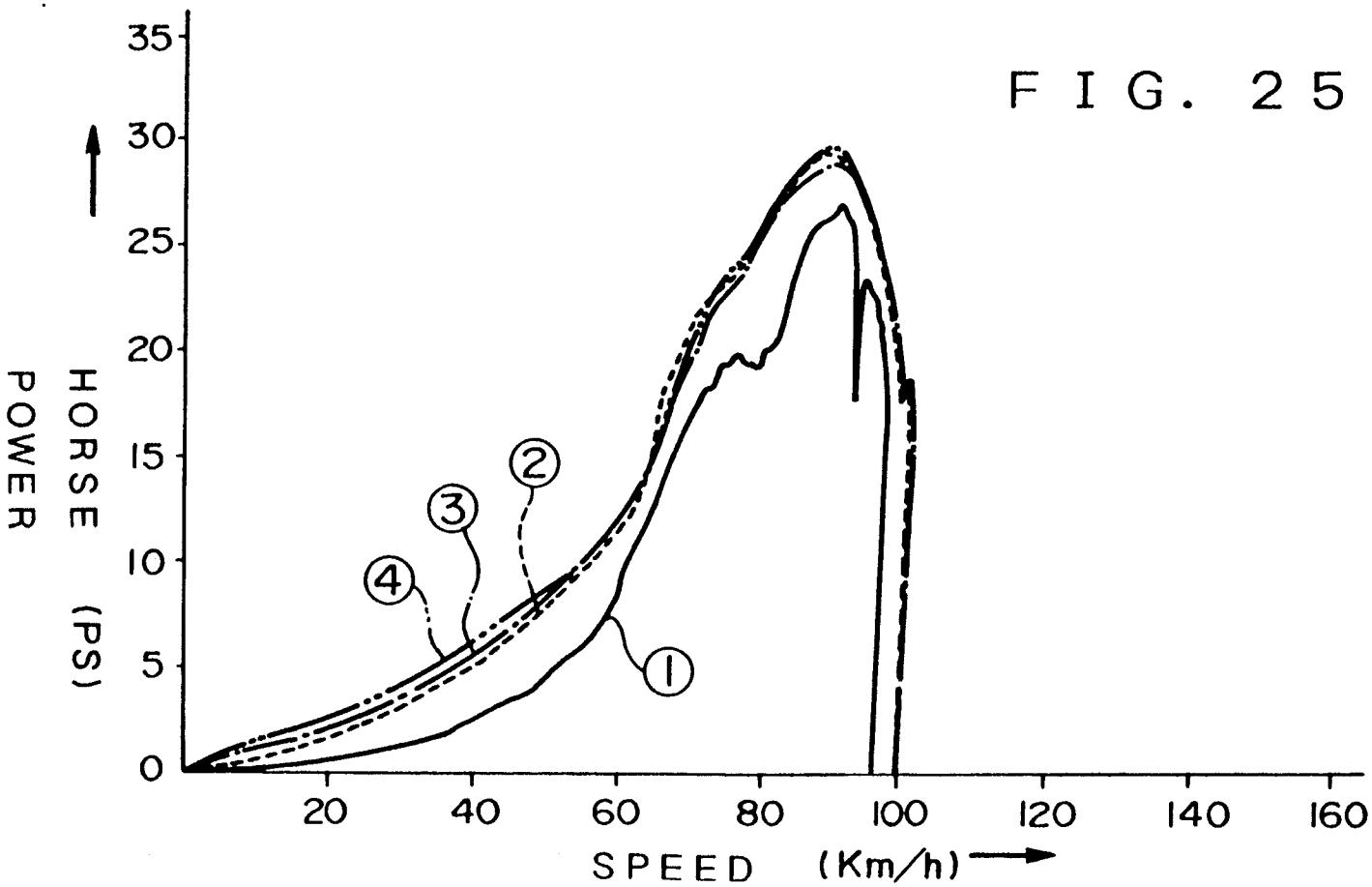
FIG. 25 is a graph showing a comparative power test for this invention and the prior art.

FIG. 25 is a graph showing the comparison result of power test between the jet needle 114 of this embodiment and the prior art. The ordinate and abscissa of the graph as shown in FIG. 25 represent horsepower and speed per hour, respectively.

Figure 26:
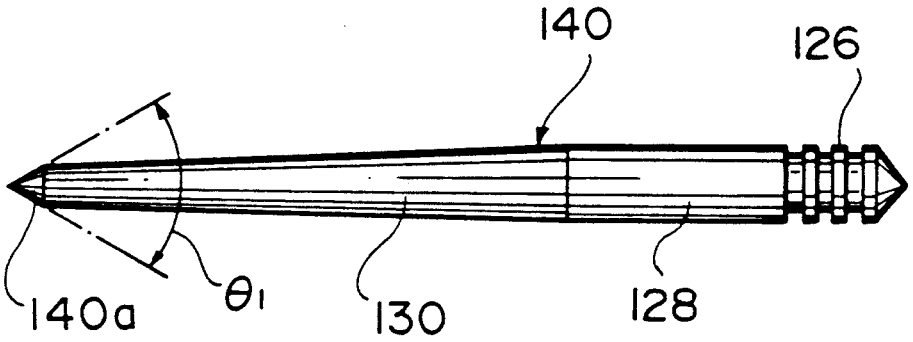
FIG. 26 shows a conventional jet needle.

In FIG. 25, a solid line (1) represents a comparative example using a conventional jet needle 140 with a conical tip portion 140*a* having a vertical angle $\theta$1 of 60 degrees as shown in FIG. 26, a broken line (2) represents an example using the jet needle having the flat tip surface as shown in FIG. 17, a one-dotted chain line (3) represents an example using the jet needle having the semi-spherical recess portion at the tip thereof as shown in FIG. 21, and a two-dotted chain line (4) represents an example using the jet needle having the notches at the tip portion thereof as shown in FIG. 23.

The dimensions of l1, l2, D, d and taper angle were set to be identical among the above examples and comparative example. 88'-type HONDA HRC RS-125 (124cc and 2 cycle, produced by Honda Company) was used as a test engine, and Keihin PJ Φ 36 (produced by Keihin Seiki Company) was used as a test carburetor.

As is apparent from the graph, large difference in horsepower (difference of about 8 horsepower at maximum) occurs from a low-speed region to a high-speed region between the jet needles of this embodiment and prior art. Particularly, the output power difference in the low-speed region is remarkably larger. This fact proves that the starting power and the accel response (output response to accel work) are improved in this invention).

The fact that the output power of the example (4) is largest in the low-speed region means that as the fuel is more greatly stirred by the jet needle, the fine granulation of fuel and/or the turbulence of the air-fuel mixture are more promoted, so that the combustion efficiency, and thus the engine efficiency can be improved.

The following table represents experimental values showing the improvement in the accel response.

In the following table, (a) represents the comparative example of the conventional jet needle as shown in FIG. 26, (b) represents a comparative example of a conventional jet needle having a conical tip portion having a vertical angle of 90 degrees, (c) represents the example of the jet needle having vertical angle of 145 degrees as shown in FIG. 19, (d) represents the example as shown in FIG. 17, (e) represents the example as shown in FIG. 20, and (f) represents the example as shown in FIG. 21. The dimension of the jet needle is identical among the above examples and comparative examples. "Road Racer 125cc" was used as a test autobicycle.

| JET NEEDLE | TIME(S) ELAPSED FROM 20 KM/H TO 140 KM/H | MAXIMUM REVOLUTION (rpm) |
|---|---|---|
| (a) | 8.1 | 12500 |
| (b) | 8.0 | 12500 |
| (c) | 7.8 | 12700 |
| (d) | 7.6 | 13000 |
| (e) | 7.4 | 13500 |
| (f) | 7.4 | 13500 |

As apparent from the table, the improvement in the accel response can be performed according to the carburetor having the fuel feeding system of this invention.

Accordingly, by designing the shape of the tip portion of the jet needle such that the fuel flow is disturbed, the knocking and the discontinuous combustion can be also overcome and the combustion efficiency (fuel consumption) can be improved.

Further, since the above effect can be obtained merely by subjecting the tip portion of the jet needle to a simple processing, the fuel feeding system of this invention can be easily manufactured, and alternately an existing fuel feeding system can be easily altered to that of this invention. Therefore, the fuel feeding system of this invention has excellent wide availability.

The roughening method for roughening the tip portion of the jet needle is not limited to the above embodiments. Various methods such as a knurling processing may be used insofar as they can promote the stirring of the fuel flow.

According to this embodiment, the fine granulation of fuel and the turbulence of air-fuel mixture can be promoted by designing the tip portion of the jet needle in a suitable form, so that high combustion efficiency and low fuel consumption can be performed, and the output power can be improved over the entire region from the low-speed region to the high-speed region. In addition, the accel response can be improved, and the knocking and the discontinuous combustion can be prevented.

The above effect can be obtained merely by changing the shape of the tip portion of the jet needle, so that the manufacturing cost can be reduced. In addition, an existing carburetor can be used by modifying it, so that the availability can be improved.

The carburetor and the fuel feeding system having the carburetor according to this invention may be applied to an injection nozzle serving as a fuel injection device, an injection nozzle for a diesel engine, and an external combustion engine such as a jet engine as well as an internal combustion engine.

What is claimed is:

1. A carburetor for generating air-fuel mixture in a suitable air-fuel ratio and feeding the mixture to an engine for combustion, comprising:

an air suction passageway through which air is fed; and a fuel feeding passageway which is disposed so as to be intersected to said air suction passageway and through which fuel is fed, said air suction passageway and said fuel feeding passageway being intercommunicated to each other, wherein said fuel feeding passageway comprises a needle jet intercommunicated to said air suction passageway for guiding the fuel into said air suction passageway and a jet needle which has a side surface with a tapered portion and is movably inserted into said needle jet to form a clearance between said jet needle and said needle jet, said clearance being adjustable by moving said jet needle in an axial direction thereof to control an amount of fuel to be fed into said air suction passageway in accordance with an opening degree of the clearance, said jet needle having a substantially flat surface portion at a tip portion of said tapered portion said side portion of the jet needle and said substantially flat surface of the tip portion being roughed to have roughened surface portions.

2. The carburetor as claimed in claim 1, wherein said roughened surface portions at the side portion and the tip portion of the jet needle keeps the fuel therein, said roughened surface portion at the side portion reducing flow resistance of the fuel flowing along the side portion.

3. The carburetor as claimed in claim 1, wherein the roughened surface portion is partly or wholly formed on the side surface of said jet needle.

4. The carburetor as claimed in claim 1, wherein said roughened surface portion has plural recesses of about 1/100 mm depth.

5. The carburetor as claimed in claim 1, wherein said roughened surface portion is formed by any one of a shot peening method, a cutting method, an etching method, a sand blast method, a coating method, a dimple processing method and a knurling method.

6. The carburetor as claimed in claim 1, wherein said substantially flat surface portion is provided with a conical recess portion.

7. The carburetor as claimed in claim 1, wherein said substantially flat surface portion is provided with a semi-spherical recess portion.

8. The carburetor as claimed in claim 1, wherein said substantially flat surface portion is provided with an uneven surface portion.

9. The carburetor as claimed in claim 1, wherein said substantially flat surface portion is provided with notches on the periphery thereof.

10. The carburetor as claimed in claim 1, wherein said air suction passageway has a wall roughened to have a roughened surface portion.

11. The carburetor as claimed in claim 1, wherein said substantially flat surface portion comprises a substantially conical portion having a vertical angle above 145 degrees.

12. The carburetor as claimed in claim 11, wherein said conical portion is provided with notches thereof.

13. A fuel feeding system for feeding air-fuel mixture to an engine in a suitable air-fuel ratio for combustion in the engine comprising:

an air suction passageway through which air is fed; and a fuel feeding passageway along which fuel is fed, said air suction passageway and said fuel feeding passageway being intercommunicated to an engine to feed air-fuel mixture to the engine for combustion, said fuel feeding passageway including a needle jet intercommunicated to said air suction passageway for guiding the fuel into said air suction passageway and jet needle having a side surface and a substantially flat surface at a tip portion thereof, said side surface and said substantially flat surface being roughened to have roughened surface portions to generate turbulence in fluid flow and promote carburetion and granulation of the air-fuel mixture due to the turbulence.

14. A carburetor for generating air-fuel mixture in a suitable air-fuel ratio and feeding the mixture to an engine for combustion, comprising:

an air suction passageway for feeding air therethrough; and a fuel feeding passageway for feeding fuel and arranged to be intersected to said air suction passageway to intercommunicate thereto, said fuel feeding passageway including a needle jet intercommunicated to said air suction passageway for guiding the fuel into said air suction passageway, and a jet needle movably inserted into said needle jet to form a clearance between said jet needle and said needle jet so that said clearance is adjustable by moving said jet needle in an axial direction thereof to control an amount of fuel to be fed into said air suction passageway in accordance with an opening degree of the clearance, said jet needle having a side surface with a tapered portion, a substantially flat surface portion at a tip portion of said tapered portion and means for disturbing flow of fuel at the tip portion to provide eddy at a rear side of the flat surface portion.

15. The carburetor as claimed in claim 14, wherein said side portion of the jet needle is roughed to have a roughed surface portion.

* * * * *